US006581956B2

(12) United States Patent
Kruajitch

(10) Patent No.: US 6,581,956 B2
(45) Date of Patent: Jun. 24, 2003

(54) DEVICE FOR RAISING AT LEAST ONE BINDING ELEMENT USED ON A BOARD FOR GLIDING

(75) Inventor: André-Jean Kruajitch, La Buisse (FR)

(73) Assignee: Look Fixations SA, Nevers (FR)

( * ) Notice: Subject to any disclaimer, the term of this patent is extended or adjusted under 35 U.S.C. 154(b) by 0 days.

(21) Appl. No.: 09/847,546

(22) Filed: May 3, 2001

(65) Prior Publication Data

US 2001/0042971 A1 Nov. 22, 2001

(30) Foreign Application Priority Data

May 18, 2000 (FR) ..... 00 06330

(51) Int. Cl.[7] ..... A63C 5/07
(52) U.S. Cl. ..... 280/618; 280/602; 280/636
(58) Field of Search ..... 280/605, 617, 280/618, 602, 636, 611, 607

(56) References Cited

U.S. PATENT DOCUMENTS 5,092,618 A 3/1992 Mayr
5,211,418 A * 5/1993 Scherubl ..... 280/607
5,413,371 A * 5/1995 Trimble ..... 280/602
5,435,588 A * 7/1995 Commier et al. ..... 280/607
5,480,175 A * 1/1996 Astier et al. ..... 280/607
5,758,894 A * 6/1998 Maggiolo ..... 280/602
6,193,262 B1 * 2/2001 Silva ..... 280/607
6,277,558 B1 * 5/2001 Arduin et al. ..... 280/607
6,244,616 B1 * 6/2001 Arduin et al. ..... 280/602
6,270,108 B1 * 8/2001 Phellipon et al. ..... 280/607

FOREIGN PATENT DOCUMENTS

FR 2785548 A1 5/2000

* cited by examiner

*Primary Examiner*—Avraham Lerner

(57) ABSTRACT

A device for raising at least one element of a binding used on a board for gliding, including: a zone for mounting the binding, integral with the board for gliding; a bearing zone, extending the mounting zone in the direction of the end of the board, wherein the end of the bearing zone facing toward the end of the board is secured to the upper face of the board by an attaching means in such a manner that the forces exerted at the location of the element of the binding are partially transmitted to the board at the location of said end of the bearing zone, and which includes a transverse groove located between the mounting zone and the bearing zone so as to allow the deformation of the bearing zone when the board is bent.

10 Claims, 2 Drawing Sheets

DEVICE FOR RAISING AT LEAST ONE BINDING ELEMENT USED ON A BOARD FOR GLIDING

TECHNICAL FIELD

The invention relates to the field of sports involving gliding over snow.

It relates more particularly to the devices used on skis and, in particular, downhill skis.

It refers more specifically to devices for raising bindings, making it possible to optimize the transmission of the bearing forces exerted by the skier toward the board.

PRIOR ART

In a known manner, boards for gliding and, in particular, downhill skis include safety bindings consisting of a stop which interacts with the toe of the boot and a heelpiece holding the rear of the boot.

It is already known to mount the binding elements on raising platforms, the aim of which is to elevate the boot above the board for gliding. This is particularly advantageous when the board for gliding has a relatively pronounced sidecut, and it is thus necessary to prevent the boot coming into contact with the snow when the board is inclined laterally.

Other raising platforms have already been proposed to provide a degree of unclamping of the ski. In this type of platform, the rigidity of the sole of the boot and that of the board are dissociated in such a manner that the behavior of the ski corresponds to the intrinsic properties of the board independent of that of the boot.

Other types of raising platform have also been proposed which, on the contrary, act as stiffener in order to increase further the rigidity and stiffness of the board, in particular in the underboot zone. One example of such a platform is, in particular, described in document FR 2 684 885, in which the various elements mounted on the platform interact with one another when a force is exerted vertically by the skier.

Another type of platform has also been proposed, such as that described in document FR 2 777 792. Such a platform is composed of a raising plate on which the elements of the binding are arranged. This raising plate rests on flexible strips which extend to the front and to the rear of the zone for mounting the binding, and bear on the upper face of the ski by means of shock-absorbing blocks.

On account of the flexibility of the longitudinal tongues, such a device does not make it possible to transmit sufficiently effective bearing forces, in particular when the skier exerts forces at the location of one of the elements of the binding. Moreover, the presence of elastomeric blocks tends to damp the behavior of the board overall, so such devices are intended more for relatively soft skis and, conversely, very dynamic skis, in particular those used in competition.

A problem which the invention proposes to solve is allowing a raising platform to modify the behavior of the board for gliding when the forces are exerted by the skier, while not increasing its stiffness in terms of flexing and thus allowing it to bend.

SUMMARY OF THE INVENTION

The invention thus relates to a device for raising at least one binding element used on a board for gliding, including:

a zone for mounting the binding, integral with the board for gliding;

a bearing zone, extending the mounting zone in the direction of the end of the board.

This device is defined in that the end of the bearing zone facing toward the end of the board is secured to the upper face of the board by attaching means in such a manner that the forces exerted at the location of the element of the binding are partially transmitted to the board at the location of said end of the bearing zone, and in that it also includes a transverse groove located between the mounting zone and the bearing zone so as to allow the deformation of this bearing zone when the board is bent.

In other words, the device according to the invention makes it possible to transfer a portion of the forces exerted by the skier in front of the stop of the binding or behind the heelpiece.

In this way, when the skier initiates a turn and exerts forces at the location of the front stop of the binding, a portion of these forces is exerted via the device according to the invention a few centimeters or even a few tens of centimeters further forward.

Under these conditions, the bearing forces are exerted in a longer zone of the underboot section, which allows an efficient turn initiation and better control through the turn.

Indeed, the platform according to the invention does not interfere with the behavior of the board when the latter bends, since the characteristic transverse groove allows the bearing zone of the platform to deform when the board flexes.

In a particular embodiment of the invention, the transverse groove may advantageously be filled with an elastic material so as to allow the return of the bearing zone into position when the cause of the bending disappears.

In other words, the presence of an elastic material makes the raising device and thus the entire board more dynamic by opposing flexing in the bearing zone.

Advantageously, in practice, the raising device may also comprise a block for receiving the other element of the binding. This block may be connected to the zone for mounting the binding via a linking pin.

Advantageously, in practice, this block may have the ability to slide longitudinally. In this case, the ability to offset the bearing forces further forward or further to the rear of the binding, without making the stiffness of the sole of the boot affect the stiffness of the board, is retained. In other words, a certain unclamping of the boot relative to the board is thus provided.

In another embodiment, the zone for mounting the binding extends in the opposite direction from the bearing zone and receives the other element of the binding.

In other words, the raising device therefore includes a platform which receives the two elements of the binding, filling in the gap between the boot and the upper face of the board.

Advantageously, in practice, the means for attaching the end of the bearing zone onto the upper face of the board allow a longitudinal displacement of said end when the board is significantly bent.

In other words, when the board is significantly bent, the end of the bearing zone may slide slightly relative to the upper face of the board in order to prevent longitudinal forces being exerted on the board.

Indeed, the attaching means have the essential function of transferring a portion of the vertical forces exerted by the skier and must not secure the raising device via two ends, at the risk of generating clamping of the board.

Advantageously, in practice, this ability of the end of the bearing zone to be displaced longitudinally may be obtained by interposing a layer of viscoelastic material between the upper face of the board and the end of the bearing zone.

In this case, this layer of viscoelastic material efficiently transmits forces which are exerted vertically, and works in shear when the bearing zone tends to be displaced longitudinally.

In practice, the lower face of the bearing zone is shaped so as to clear a free space between the bearing zone and the upper face of the board, between the end secured to the board and the mounting zone.

In other words, only the end of the bearing zone comes into contact with the board in order not to risk clamping the board and to push back as far as possible from the binding the zone in which the forces are transferred.

According to a particular embodiment, the bearing zone may have two arms extending in the longitudinal direction of the board, these arms being connected in the vicinity of the zone for mounting the binding and at the location of the means for attaching onto the board.

In this way, the transmission of forces in the vicinity of the lateral zones of the board, substantially in line with the edges, is promoted.

BRIEF DESCRIPTION OF THE FIGURES

The way in which the invention is embodied and the advantages arising therefrom will become clearly apparent from the description of the following embodiment, supported by the appended figures, in which.

EMBODIMENT OF THE INVENTION

As already stated, the invention relates to a raising device designed to be placed on a board for gliding such as, in particular, a downhill ski.

Figure 1:
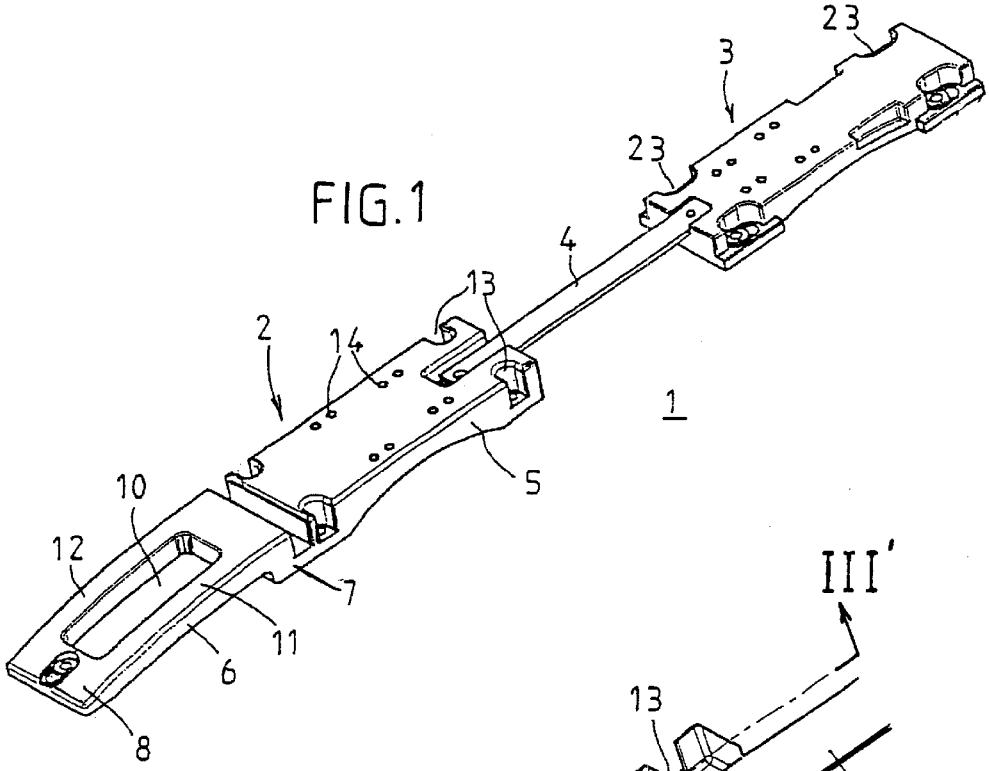
FIG. 1 is a summary perspective view of a raising device according to the invention, shown in its entirety.
Figure 2:
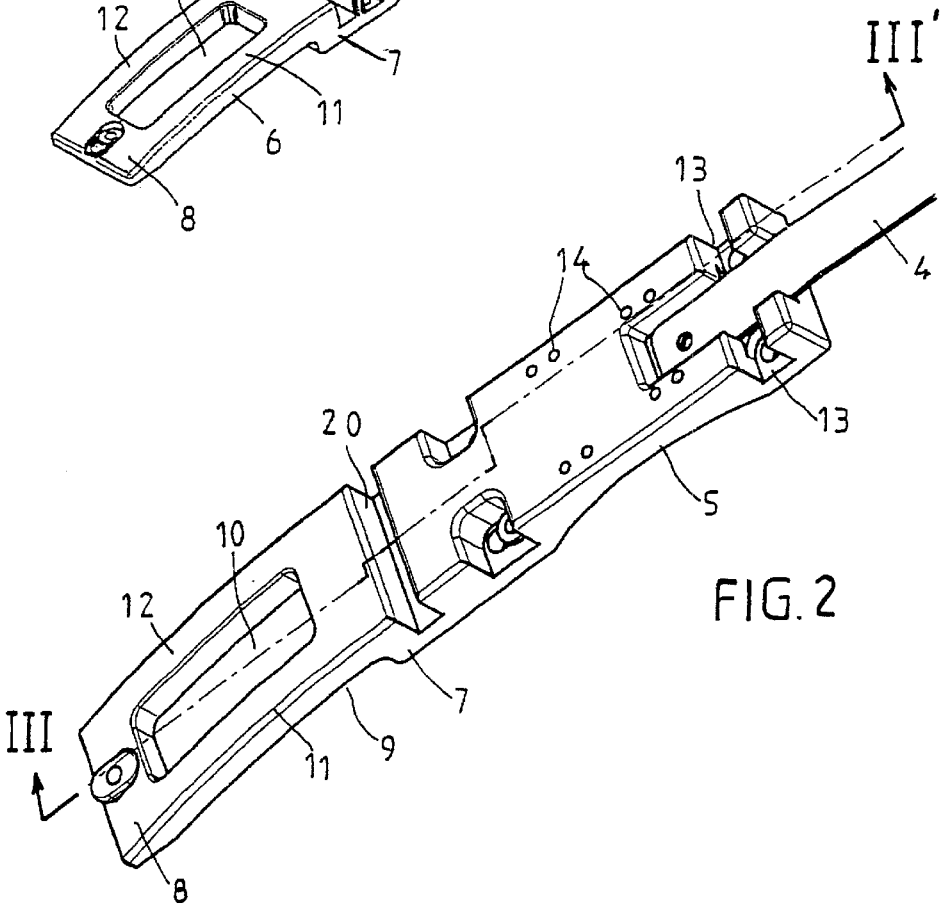
FIG. 2 is a summary perspective view of the device of FIG. 1, shown solely in its front part.

Several different architectures may be employed while remaining within the spirit of the invention, and the latter is not limited to the single embodiment illustrated in FIG. 1.

Thus, as illustrated in FIG. 1, the raising device (1) comprises a front part (2) and a rear part (3) which are connected by a rigid tongue (4). The front part (2) includes a zone (5) for mounting the binding and a bearing zone (6).

Naturally, the invention is not limited to this particular geometry, but also covers variants in which the characteristic zone (2) receives the heelpiece of the binding instead of the stop.

Moreover, the invention also covers variants in which the raising device includes two characteristic zones, each including a bearing zone, associated with the stop and the heelpiece of the binding.

Returning to the variant illustrated in FIG. 1, the characteristic zone (2) supporting the stop comprises a zone (5) for mounting the binding which is secured to the upper face of the board at the location of four attaching points which are located substantially at the four corners of the mounting zone (5).

This mounting zone thus includes four housings (13) for receiving screws for securing onto the board.

These housings (13) open out laterally to allow the evacuation of any accumulations of snow or ice which might form there.

In order to avoid modifying the natural camber of the board, the lower face of the mounting zone (5) of the raising device has a curve which is greater than that of the board.

In this way, when the device is mounted on the board it does not generate interfering forces which act against the natural camber of the board.

The upper face of the zone for mounting the binding includes a plurality of holes (14) for receiving the screws for securing the stop of the binding.

The zone (5) for mounting the binding extends forward via the bearing zone (6). These two zones are connected by a linking portion (7) located in front of the zone for mounting the binding.

This bearing zone (6) is thus mechanically integral with the zone (5) for mounting the binding, and the linking zone (7) allows the transmission of the bearing forces exerted at the location of the zone (5) for mounting the binding.

Figure 3:
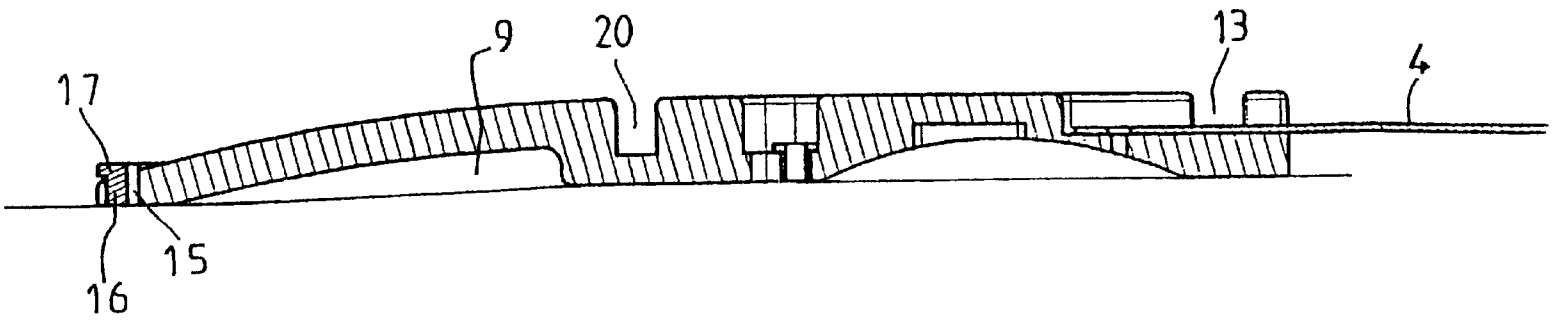
FIG. 3 is a sectional view along the arrows III-III' of FIG. 2.
Figure 4:
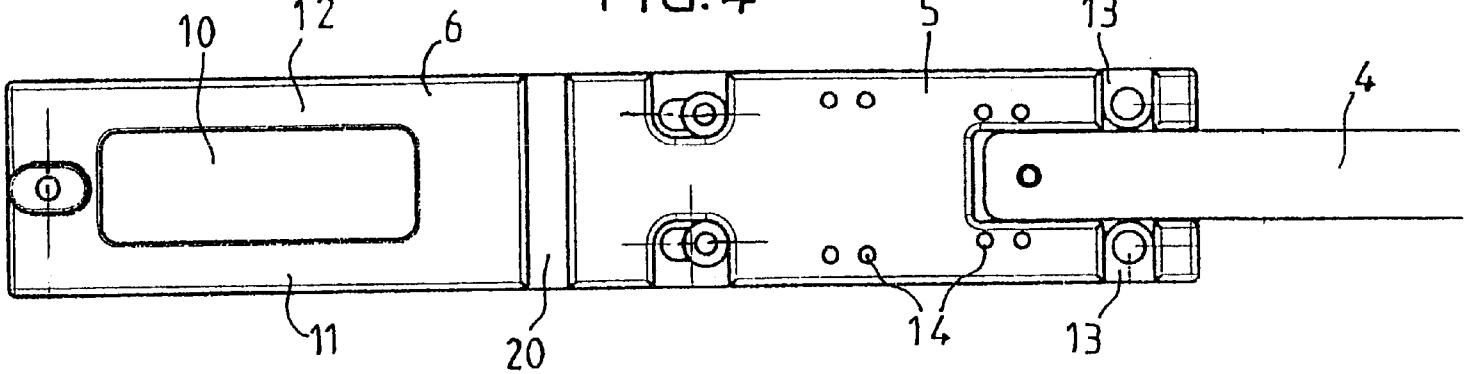
FIG. 4 is a top view of the front part of the device of FIG. 2.

The bearing zone (6) starts above the linking zone (7) and it should be noted that the bearing zone comes into contact with the board only at the location of its front end (8). Thus, between the linking zone (7) and the attaching zone (8), the bearing zone (6) defines an empty space above the upper face of the board, as illustrated in FIG. 3.

In the embodiment illustrated, the bearing zone (6) includes a central recess (10) which defines two parallel arms (11, 12). These two arms (11, 12) are integral with the attaching zone (8) and are substantially in line with the lateral zones of the board, in line with the edges. The forces exerted from the zone (5) for mounting the binding in the direction of the attaching zone (8) are thus transmitted by these two lateral arms (11, 12) in such a manner that the forces are exerted in an enhanced manner in line with the lateral zones of the board, at the location of the edges.

In the embodiment illustrated, the attaching zone (8) includes a longitudinally elongate through-aperture (15).

This aperture (15) receives a block (16) which has a shoulder (17). This shoulder (17) holds the attaching zone (8) at the location of the board and prevents the bearing zone (6) lifting up.

The elongate aperture (15) allows a slight displacement of the attaching zone in front of the position of the block (16). The block (16) firmly positions the attaching zone (8) against the board, and thus ensures good transmission of the forces exerted at the location of the zone (5) for mounting the binding.

According to the invention, the raising device also includes a transverse groove (20) located between the zone (5) for mounting the binding and the bearing zone (6), intended to allow the bearing zone (6) a certain ability to flex as regards the zone (5) for mounting the binding.

This transverse groove (20) may advantageously be filled with a material which allows adjustment of its ability to flex. Thus, this material may be chosen for its elastic properties, thus making it possible to make the device more dynamic.

Among elastic materials, those which have shock-absorbing capacities, such as viscoelastic materials, may also be favored. In this case, it is also possible to absorb a portion of the energy produced when the viscoelastic material is squashed, and thus to damp the raising device. These materials may be natural rubber, synthetic rubber, or thermoplastic materials such as polyurethane or the like.

In the embodiment illustrated in FIG. 1, the zone (5) for mounting the binding includes a housing for receiving the rigid tongue (4) for linking with the rear part (3). This rigid metallic tongue (4) makes it possible to secure the front (2) and rear (3) parts of the raising device.

In the embodiment illustrated, the rear block (3) is mounted on the upper face of the board by means of four screws (23) passing through four longitudinally elongate apertures.

In this way, the rear block has a certain ability to slide longitudinally. This gives rise to a constant spacing between the stop and the heelpiece of the binding, while rendering the rigidity of the sole of the boot and that of the board independent.

This unclamping makes it possible to use the board without interfering with its intrinsic mechanical properties.

During operation, the raising device according to the invention makes it possible to transfer a portion of the forces exerted by the skier at the location of the stop of the binding. These forces are transmitted via the linking zone (7) and the material filling the transverse groove (20) to the bearing zone. As this bearing zone (6) is secured to the upper face of the board at the location of the attaching zone (8), a portion of the forces from the skier are thus exerted on the upper face of the ski approximately twenty centimeters in front of the location of the stop.

As a result of this, the behavior of the ski, particularly when initiating a turn, corresponds to that of a relatively stiff ski, which facilitates the initiation of the turn. This increase in stiffness disappears when the skier eases his/her bearing forces at the location of the stop.

When the board tends to bend halfway through the turn, or in contact with an obstacle on the snowy slope, the transverse groove (20) allows flexing of the raising device by means of compression of the material filling it.

In this way, the longitudinal stiffness of this bearing zone is not added to that of the board when this is unnecessary.

When the material filling the transverse groove (20) is particularly elastic, this helps to accelerate the return of the bearing zone into a rest position. When the flexing movement of the board is particularly acute and when the ability of the material filling the transverse groove (20) to compress has been employed, the attaching zone (8) may then slide relative to the upper face of the board in order to prevent clamping.

Nevertheless, in such an embodiment, such an ability to slide is not essential in order to obtain satisfactory results.

It emerges from the aforesaid that the device according to the invention has a number of advantages such as, in particular:

the transfer of a portion of the forces exerted at the location of the binding element;

unclamping of the raising platform relative to the board by virtue of a simple ability to flex;

the possibility of adjusting the behavior of the platform, in particular its ability to provide greater dynamism.

What is claimed is:

1. A device (1) for raising at least one element of a binding used on a board for gliding, including:

a mounting zone (5) for mounting said one element of the binding, fixed to the board to prevent movement of said mounting zone relative to said board;

a bearing zone (6), extending from the mounting zone (5) in a direction toward a front end of the board, wherein an end (8) of the bearing zone facing toward the front end of the board is pressed against and not fixed to an upper face of the board in such a manner that forces exerted at a location of said one element of the binding are partially transmitted to the board at a location of said end (8) of the bearing zone (6), wherein the bearing zone includes a transverse groove (20), transverse to a longitudinal direction of the board, located between the mounting zone (5) and the bearing zone (6) so as to allow deformation of the bearing zone (6) when the board becomes bent.

2. The device as claimed in claim 1, wherein the groove (20) is filled with an elastic material so as to allow a return of the bearing zone (6) into a rest position when the cause of the bending disappears.

3. The device as claimed in claim 1, which also comprises a block (3) for receiving an other element of the binding, said block being connected to the mounting zone by a linking pin (4).

4. The device as claimed in claim 3, wherein the block (3) has the ability to slide longitudinally.

5. The device as claimed in claim 1, wherein the mounting zone (5) extends in an opposite direction from the bearing zone and receives the other one element of the binding.

6. The device as claimed in claim 1, wherein the attaching means (15–17) permits longitudinal displacement of said end when the board is significantly bent.

7. The device as claimed in claim 1, wherein a lower face of the bearing zone (6) is shaped so as to provide a free space (9) between the bearing zone (6) and an upper face of the board, between the end (8) engaged against the board and the mounting zone (5).

8. The device as claimed in claim 6, wherein the bearing zone (6) has two arms (11, 12) extending in the longitudinal direction of the board, said arms being connected in the vicinity of the mounting zone at the location of the attaching means.

9. The device as claimed in claim 1, wherein a layer of viscoelastic material is interposed between the bearing zone and the upper face of the board.

10. A device (1) for raising at least a toe binding used on a board for gliding, including:

a mounting zone (5) for mounting said toe binding, fixed to the board to prevent movement of said mounting zone relative to said board;

a bearing zone (6), extending from the mounting zone (5) in a direction toward a front end of the board, wherein an end (8) of the bearing zone facing toward the front end of the board is movably pressed against an upper face of the board by attaching means (16) in such a manner that forces exerted at a location of said toe binding are partially transmitted to the board at a location of said end (8) of the bearing zone (6), wherein the bearing zone includes a transverse groove (20), transverse to a longitudinal direction of the board, located between the mounting zone (5) and the bearing zone (6) so as to allow deformation of the bearing zone (6) when the board becomes bent.

* * * * *